US010012103B2

(12) United States Patent
Pachidis et al.

(10) Patent No.: US 10,012,103 B2
(45) Date of Patent: Jul. 3, 2018

(54) GUIDE VANE

(71) Applicant: ROLLS-ROYCE PLC, London (GB)

(72) Inventors: Vasileios Pachidis, Milton Keynes (GB); Carlos Soria, Milton Keynes (GB)

(73) Assignee: ROLLS-ROYCE plc, London (GB)

( * ) Notice: Subject to any disclaimer, the term of this patent is extended or adjusted under 35 U.S.C. 154(b) by 379 days.

(21) Appl. No.: 14/925,149

(22) Filed: Oct. 28, 2015

(65) Prior Publication Data

US 2016/0130973 A1 May 12, 2016

(30) Foreign Application Priority Data

Nov. 10, 2014 (GB) ..... 1419951.7

(51) Int. Cl.
*F01D 17/14* (2006.01)
*F01D 5/14* (2006.01)
(Continued)

(52) U.S. Cl.
CPC ..... *F01D 17/14* (2013.01); *F01D 5/146* (2013.01); *F01D 5/148* (2013.01); *F01D 9/041* (2013.01);
(Continued)

(58) Field of Classification Search
CPC ..... F01D 17/14; F01D 17/162; F01D 17/16; F01D 17/165; F01D 5/148; F01D 5/146;
(Continued)

(56) References Cited

U.S. PATENT DOCUMENTS 4,897,020 A 1/1990 Tonks
5,520,511 A * 5/1996 Loudet ..... F01D 5/148 415/148
(Continued)

FOREIGN PATENT DOCUMENTS

EP 1780378 A2 5/2007
FR 2908828 A1 * 5/2008 ..... F01D 11/003
GB 805015 A 11/1958

OTHER PUBLICATIONS

Mar. 14, 2016 Search Report issued in European Patent Application No. 15 19 1851.
(Continued)

*Primary Examiner* — Ninh H Nguyen
*Assistant Examiner* — Topaz L Elliott
(74) *Attorney, Agent, or Firm* — Oliff PLC

(57) ABSTRACT

A gas turbine engine variable guide vane has a fixed portion on an upstream side, a movable flap on a downstream side and a transfer slot between a fixed portion trailing surface and a movable flap leading surface. The movable flap has opposite pressure and suction sides along a chord line between leading and trailing edges, and is rotatable about an axis along a movable flap span over a range of angular positions between open and closed. The trailing surface has a substantially U-shaped profile with first and second branches respectively partially around the pressure and suction sides. The transfer slot has inlet and exhaust ports respectively on the pressure and suction sides. In the closed position the suction side contacts the second branch closing the exhaust port, and in the open position the second branch directs a first air flow through the transfer slot tangentially over the suction surface.

10 Claims, 3 Drawing Sheets

(51) Int. Cl.

| | |
|---|---|
| ***F01D 9/04*** | (2006.01) |
| ***F01D 25/10*** | (2006.01) |
| ***F04D 29/56*** | (2006.01) |
| ***F04D 29/68*** | (2006.01) |
| ***F01D 17/16*** | (2006.01) |

(52) U.S. Cl.
CPC ..... *F01D 17/162* (2013.01); *F01D 25/10* (2013.01); *F04D 29/563* (2013.01); *F04D 29/684* (2013.01); *F05D 2220/32* (2013.01); *F05D 2240/12* (2013.01); *F05D 2250/14* (2013.01); *F05D 2250/75* (2013.01); *F05D 2270/17* (2013.01)

(58) Field of Classification Search
CPC .. F04D 29/563; F04D 29/684; F05D 2250/75; F05D 2250/14; F05D 2250/90; F05D 2270/17
See application file for complete search history.

(56) References Cited

U.S. PATENT DOCUMENTS

| | | | | |
|---|---|---|---|---|
| 7,055,304 | B2 * | 6/2006 | Courtot | F01D 5/146 244/134 B |
| 9,062,559 | B2 * | 6/2015 | Little | F01D 17/162 |
| 2005/0109011 | A1 | 5/2005 | Courtot et al. | |
| 2007/0092372 | A1 * | 4/2007 | Carroll | F01D 5/148 415/191 |
| 2013/0031913 | A1 * | 2/2013 | Little | F01D 17/162 60/796 |

OTHER PUBLICATIONS

Apr. 30, 2015 Search Report issued in British Patent Application No. 1419551.7.

* cited by examiner

GUIDE VANE

This invention claims the benefit of UK Patent Application No. 1419951.7, filed on 10 Nov. 2014, which is hereby incorporated herein in its entirety.

FIELD OF THE INVENTION

The present invention relates to an inlet guide vane for a gas turbine engine and particularly, but not exclusively, to an inlet guide vane for a compressor of a gas turbine engine.

BACKGROUND TO THE INVENTION

Compressors are widely used in turbomachinery applications to compress an intake airflow. It is known to provide the airflow entering the front stages of the compressor with a specific axial orientation in order to maximise the efficiency of the compressor and/or to provide an adequate stability margin.

This airflow orientation is determined by the stagger angle of the guide vanes directing air onto the rotor stages of the compressor.

The compressor blading is designed to deliver optimum performance at a design point and therefore, changes in rotational speed and air mass flow during operation away from the design point result in changes in airflow velocity components which, in turn, penalises off-design performance.

Since variable operating conditions are encountered during operation of a typical gas turbine engine, it is known to use variable guide vanes which may be rotated around an axis so varying the stagger to meet engine operability requirements.

A conventional compressor is typically equipped with variable inlet guide vanes as well as several rows of variable stator vanes that each redirect the airflow by a rigid rotation.

A problem with such arrangements is that when they are rotated at off-design conditions, the airflow may separate along the blade surfaces.

For example, for a variable inlet guide vane it can be assumed that the incoming airflow has approximately the same flow angle at every operating condition. At the design point, the variable inlet guide vanes are aligned to the incoming airflow because redirecting the flow is not necessary. However, away from the design point (i.e. at part speed conditions) the variable inlet guide vane is rotated to achieve the outlet flow angle that would result in an acceptable rotor blade incidence. Since the variable inlet guide vane rotates rigidly while the incoming airflow direction does not change, the airflow incidence at the variable inlet guide vane inlet increases. This can cause air flow separation with a consequent increase in pressure loss.

It is known to provide the variable inlet guide vane with a constant leading edge angle and a variable trailing edge angle using a hinged or 'variable camber line' configuration. One such approach uses a tandem aerofoil design to achieve this, with such geometry providing a sensible reduction in pressure losses.

A known disadvantage with this approach is that such tandem aerofoil arrangements are susceptible to flow separation on the moving part of the aerofoil at high turning angles. This is due to the fact that tandem aerofoil profiles have a geometrical discontinuity that can trigger flow separation. This flow separation is particularly pronounced at operating conditions away from the design point because this necessitates high turning angles which cause this discontinuity to be more pronounced.

STATEMENTS OF INVENTION

According to a first aspect of the present invention there is provided a variable guide vane for a gas turbine engine comprising:

a fixed portion arranged on an upstream side;

a movable flap arranged on a downstream side; and a transfer slot defined between a trailing surface of the fixed portion and a leading surface of the movable flap, the movable flap having opposite pressure and suction sides extending along a chord line between leading and trailing edges, the movable flap being rotatable about an axis extending along a span of the movable flap over a range of angular positions between open and closed, the trailing surface having a substantially U-shaped profile with a first branch extending partially around the pressure side of the movable flap, and an opposite second branch extending partially around the suction side of the movable flap, the transfer slot having an inlet port arranged on the pressure side of the movable flap and an exhaust port arranged on the suction side of the movable flap, wherein in use, in the open position the suction side abuts the second branch to close the exhaust port, and in the closed position the second branch directs a first air flow passing through the transfer slot tangentially over the suction surface of the movable flap.

By directing the first air flow tangentially over the suction surface of the movable flap, the arrangement acts to re-energise the boundary layer on the suction surface of the movable flap. This in turn reduces the pressure loss due to flow separation over the flap surface, and so increases the compressor pressure ratio and efficiency.

A further advantage of this boundary layer re-energisation is an associated reduction in specific fuel consumption and an increase in thermal efficiency.

Optionally, the fixed portion comprises an internal cavity, the internal cavity being in fluid communication with the transfer slot, the internal cavity being supplied with air at a pressure higher than the airflow passing through the transfer slot, and, in use, directing a second air flow into the transfer slot, directed towards the exhaust port, to thereby supplement the first air flow.

By supplementing the first air flow, the second air flow increases the efficiency with which the boundary layer flow across the suction side of the movable flap can be re-energised.

Additionally, the combined first and second air flows provide for the boundary layer flow to be re-energised more quickly and over a wider range of engine operating conditions than for the first air flow alone.

Consequently, the addition of the second air flow increases the efficiency of the arrangement, so making it more advantageous for a user.

Optionally, the internal cavity is fluidly connected to the transfer slot by a plurality of feed slots, the feed slots being arranged along the span of the movable flap.

The feed slots direct the second air flow into the first air flow as it passes though the transfer slot. The size of the feed slots and their distribution along the span of the arrangement can be configured to optimise the boundary layer flow re-energisation across the movable flap, for example, by taking into account the end effects at a root and a tip of the guide vane.

Optionally, the transfer slot has a convergent flow path in a direction extending from the pressure side of the movable flap to the suction side of the movable flap.

The convergent flow path of the transfer slot acts to increase the velocity of the first air flow as it passes through the transfer slot. This increases the efficiency of the first air flow in re-energising the boundary layer across the suction surface of the movable flap.

Optionally, a camber line of the movable flap is coincident with the chord line.

With the camber line coincident with the chord line, the movable flap has a symmetric cross-sectional profile. An advantage of this feature is that the boundary layer re-energisation by the first air flow is more efficient than is the case for an asymmetric or cambered profile.

Optionally, the axis of the movable flap is offset from the chord line.

By offsetting the axis of the movable flap it becomes possible to alter the angular position of the movable flap at which the second branch contacts the suction side of the movable flap to close the exhaust port of the transfer slot. This in turn allows for the tailoring of the range of angular motion of the movable flap over which the boundary layer re-energisation flow is provided.

Optionally, the offset of the axis is in a direction extending towards the pressure side of the movable flap.

By offsetting the axis of rotation of the movable flap towards the pressure side of the movable flap, it becomes possible to provide an exhaust flow from the transfer slot that is tangential to the suction surface of the movable flap, over a range of angular movement of the movable flap.

Optionally, the second branch has an elliptical sectional profile.

The sectional profile of the second branch defines the directional profile of the first air flow as it leaves the exhaust port and is directed over the suction surface of the movable flap.

In this arrangement, the elliptical profile of the second branch provides a smooth transition between the transfer port and a flow direction tangential to the suction surface of the movable flap.

In other arrangements, the sectional profile of the second branch may have an alternative profile such as, for example, hyperbolic.

Optionally, the variable guide vane further comprises a heater adapted to impart heat energy to the second air flow.

An advantage of providing heat energy to the second air flow is that it can prevent the formation of ice on an outer upstream surface of the fixed portion.

A further advantage is that it can prevent ice formation in the feed slots between the internal cavity of the fixed portion and the transfer slot, which might otherwise reduce the efficiency of the re-energisation of the boundary layer over the suction surface of the movable flap.

According to a second aspect of the present invention there is provided a gas turbine engine comprising a variable guide vane according to the first aspect.

Other aspects of the invention provide devices, methods and systems which include and/or implement some or all of the actions described herein. The illustrative aspects of the invention are designed to solve one or more of the problems herein described and/or one or more other problems not discussed.

BRIEF DESCRIPTION OF THE DRAWINGS

There now follows a description of an embodiment of the invention, by way of non-limiting example, with reference being made to the accompanying drawings in which.

It is noted that the drawings may not be to scale. The drawings are intended to depict only typical aspects of the invention, and therefore should not be considered as limiting the scope of the invention.

DETAILED DESCRIPTION

Figure 1:
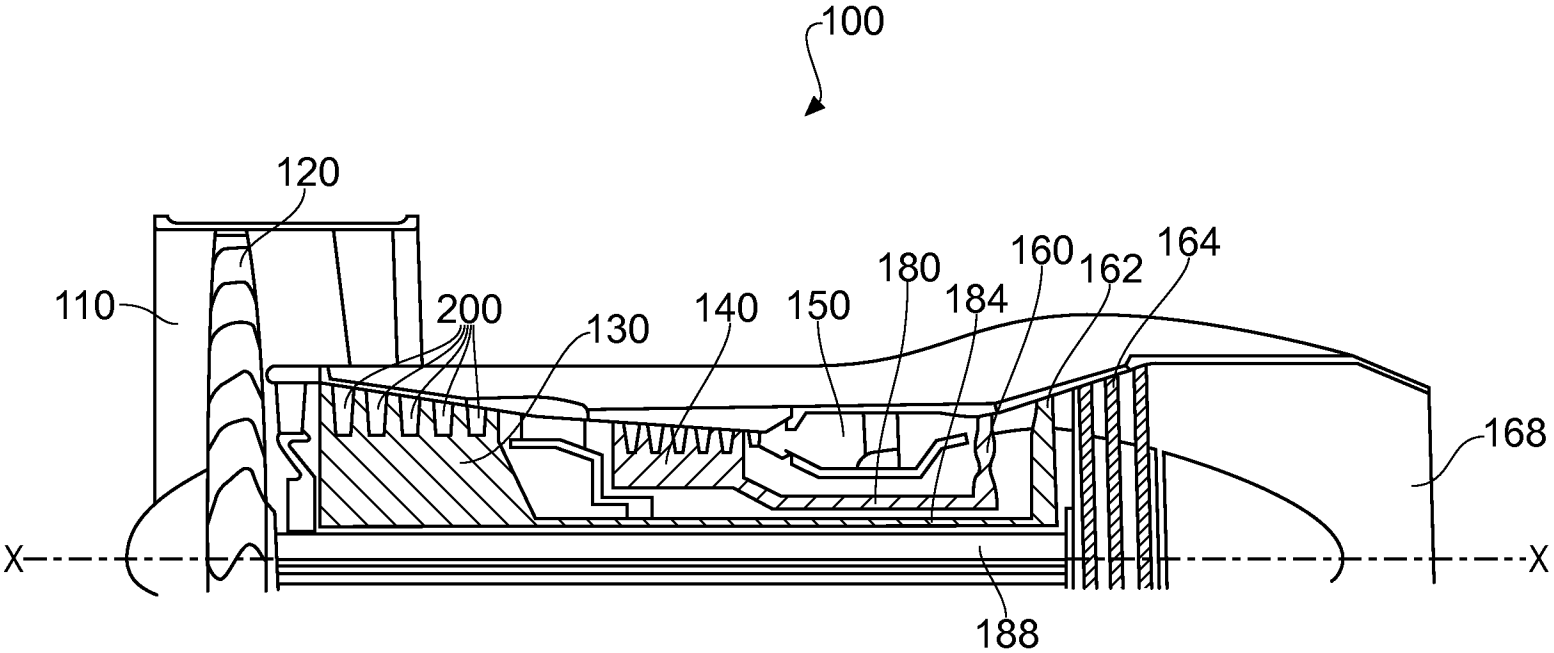
FIG. 1 shows a schematic sectional view of a gas turbine engine incorporating a variable guide vane according to the present invention.
Figure 2:
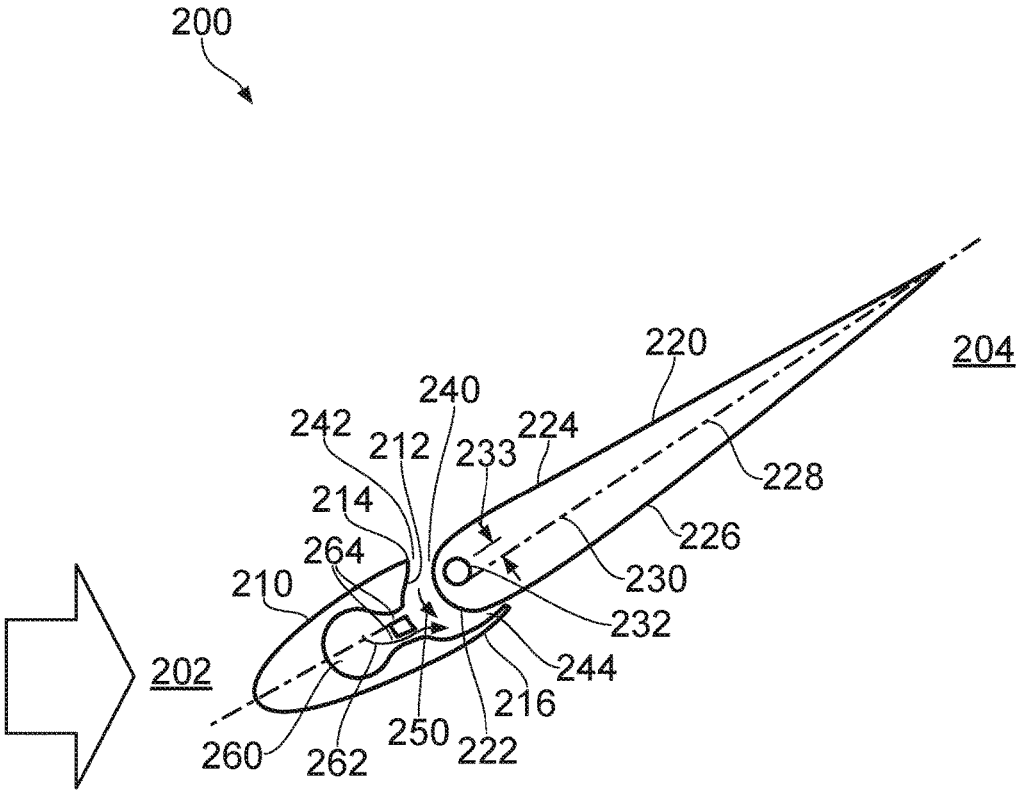
FIG. 2 shows a sectional view of the variable guide vane of FIG. 1, with the movable flap in the open position.
Figure 3:
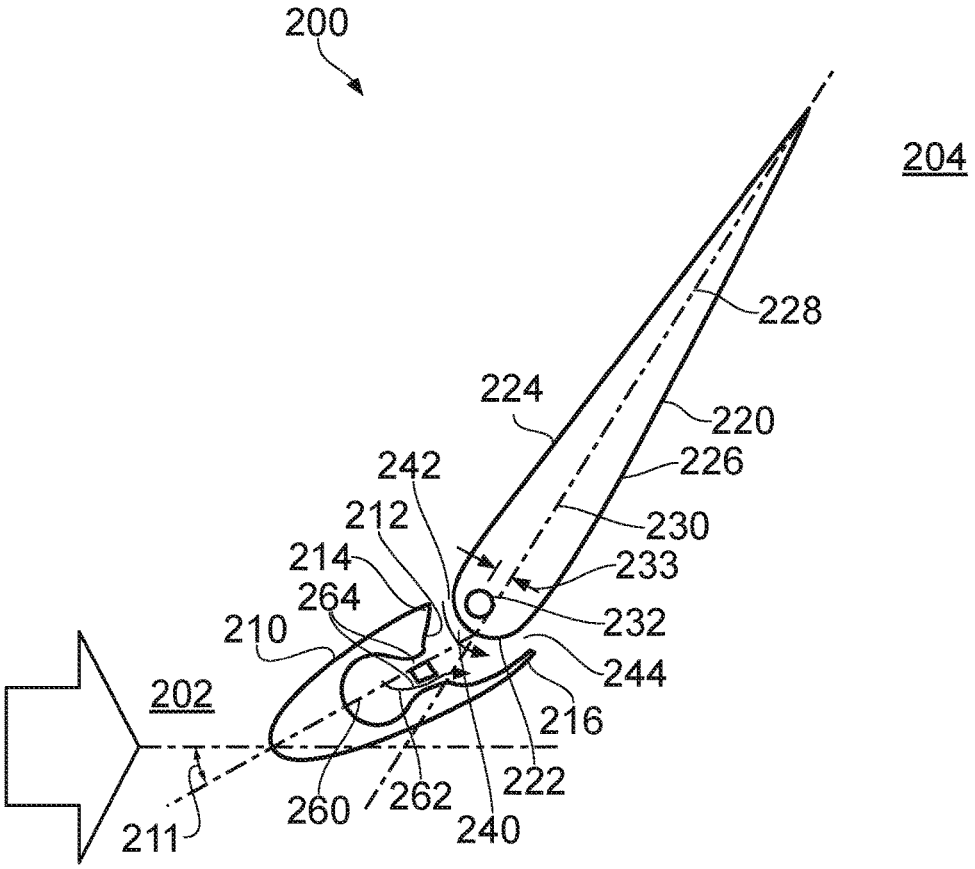
FIG. 3 shows the variable guide vane of FIG. 1, with the movable flap in the closed position.

Referring to FIGS. 1 to 3, a variable guide vane for a gas turbine engine according to a first embodiment of the invention is designated generally by the reference numeral 200.

FIG. 1 shows a schematic arrangement of a gas turbine engine for a typical aerospace application. The gas turbine engine 100 comprises in flow series an intake 110, a fan 120, an intermediate pressure compressor 130, a high pressure compressor 140, a combustion chamber 150, a high pressure turbine 160, an intermediate pressure turbine 162, a low pressure turbine 164 and an exhaust 168. The high pressure turbine 160 is arranged to drive the high pressure compressor 140 via a first shaft 180. The intermediate pressure turbine 162 is arranged to drive the intermediate pressure compressor 130 via a second shaft 184 and the low pressure turbine 164 is arranged to drive the fan 120 via a third shaft 188. In operation air flows into the intake 110 and is compressed by the fan 120. A first portion of the air flows through, and is compressed by, the intermediate pressure compressor 130 and the high pressure compressor 140 and is supplied to the combustion chamber 150. Fuel is injected into the combustion chamber 150 and is burnt in the air to produce hot exhaust gases which flow through, and drive, the high pressure turbine 160, the intermediate pressure turbine 162 and the low pressure turbine 164. The hot exhaust gases leave the low pressure turbine 164 and flow through the exhaust 168 to provide propulsive thrust. A second portion of the air bypasses the main engine to provide propulsive thrust.

Typically, the intermediate pressure compressor 130 will include airflow control in the form of variable inlet guide vanes 200 for the first stage together with variable stator vanes 200 for the succeeding stages. In this way, as the compressor speed is reduced from its design value these static vanes 200 are progressively closed in order to maintain an acceptable air angle value onto the following rotor blades.

The variable guide vane 200 comprises a fixed portion 210 arranged on an upstream side 202 of the guide vane 200, a movable flap 220 arranged on a downstream side 204 of the guide vane 200, and a transfer slot 240 defined between a trailing surface 212 of the fixed portion 210 and a leading surface 222 of the movable flap 220.

The fixed portion 210 has a streamlined upstream side with the downstream side being shaped to accommodate the leading edge surfaces 222 of the movable flap 220.

The movable flap 220 has an aerofoil cross-sectional profile with opposing pressure and suction sides 224,226 extending along a chord line 228 between a leading edge and a trailing edge. In the present arrangement, a camber line 230 of the movable flap 220 is coincident with the chord line 228, thus providing the movable flap 220 with a symmetric, or uncambered, aerofoil cross-section. In other arrangements, the movable flap 220 may have an asymmetrical or cambered cross-sectional profile.

The movable flap 220 is rotatable about an axis 232 extending along a span of the movable flap 220 over a range of angular positions between open and closed. In the present arrangement, the axis 232 is offset 233 from the chord line 228 of the movable flap 220 in the direction of the pressure side 224 of the movable flap 220. In other arrangements, the axis 232 may be positioned on the chord line 228 or, alternatively, may be offset 233 towards the suction side of the movable flap 220.

The trailing surface 212 of the fixed portion 210 has a substantially U-shaped cross-sectional profile having a first branch 214 and an opposite second branch 216.

The first branch 214 extends partially around the pressure side 224 of the movable flap 220, with the space between the first branch 214 and the pressure side 224 defining an inlet port 242 to the transfer slot 240. The second branch 216 extends partially around the suction side 226 of the movable flap 220, with the space between the second branch 216 and the suction side 226 defining an exhaust port 244 to the transfer slot 240. The second branch 216 has an elliptically shaped sectional profile.

The transfer slot 240, comprising the space between the trailing surface 212 of the fixed portion 210 and the leading surface 222 of the movable flap 220, is an elongate slot 240 extending along the entire span of the movable flap 220. In other arrangements, the transfer slot 240 may extend only partially along the span of the movable flap 220.

The transfer slot 240 has an inlet port 242 arranged on the pressure side 224 of the movable flap 220 and an exhaust port 244 arranged on a suction side of the movable flap 220. In the present arrangement, the transfer slot 240 has a convergent cross-sectional profile in a direction from the inlet port 242 to the exhaust port 244.

The fixed portion 210 comprises an internal cavity 260 extending along a spanwise length of the fixed portion 210. This internal cavity 260 is fluidly connected to the transfer slot 240 via a plurality of feed slots 264. These feed slots 264 are arranged along the length of the internal cavity 260 in an equi-spaced linear array. In other arrangements, the feed slots 264 may be asymmetrically arranged along the spanwise length of the internal cavity 260.

As mentioned above, the movable flap 220 is rotatable between an 'open' position (shown in FIG. 2) and a 'closed' position (shown in FIG. 3). In this context, the terms 'open' and 'closed' are used to refer to the degree of restriction imposed on the airflow into the compressor by the variable guide vanes 200. In other words, in the 'open' position the movable flap 220 is positioned so as to be substantially aligned with the fixed portion 210, which provides minimum restriction to the intake air flow. Similarly, in the 'closed' position the movable flap 220 is rotated such that its suction side 226 moves towards the intake air flow, so restricting and redirecting the intake air flow into the compressor.

With the movable flap 220 in the 'open' position, an air flow entering the compressor of the engine passes over the fixed portion of the variable guide vane 200. In this position, the suction side 226 of the movable flap 220 abuts the second branch 216 of the trailing surface 212 of the fixed portion 210 to close off the exhaust port 244. In normal operation, the suction side 226 of the movable flap 220 will be close to but not in contact with the second branch 216 of the trailing surface 212. However, contact between these surfaces 226,216 may occur under some operational conditions. In any event, with the movable flap 220 in the 'open' position there can be no flow through the transfer slot 240.

As the movable flap 220 is rotated towards the 'open' position, the suction side 226 of the movable flap 220 moves away from the second branch 216 and the exhaust port 244 opens. This allows a first air flow 250 to pass through the transfer slot 240.

Since the pressure on the pressure side 224 of the movable flap 220 is higher than that on the suction side 226, the first air flow 250 will enter the inlet port 242 of the transfer slot 240. The convergent cross-sectional profile of the transfer slot 240 will further accelerate the velocity of the first air flow 250 along the transfer slot 240.

The internal cavity 260 of the fixed portion 210 is provided with a pressurised air feed, in this arrangement taken from a later stage of the compressor. This pressurised air is fed, as a second air flow 262, through the feed slots 264 between the internal cavity 260 and the transfer slot 240, and into the transfer slot 240 where it supplements the first air flow 250.

The combined first and second air flows 250,262 then exit the transfer slot 240 through the exhaust port 244. The elliptically shaped profile of the exhaust port 244 directs the exhaust flow tangentially over the suction surface 226 of the movable flap 220. This tangential flow serves to re-energise the boundary layer on the suction side 226 of the movable flap 220. This in turn acts to minimise pressure loss resulting from flow separation across the suction side 226.

The foregoing description of various aspects of the invention has been presented for purposes of illustration and description. It is not intended to be exhaustive or to limit the invention to the precise form disclosed, and obviously, many modifications and variations are possible. Such modifications and variations that may be apparent to a person of skill in the art are included within the scope of the invention as defined by the accompanying claims.

The invention claimed is:

1. A variable guide vane for a gas turbine engine comprising:

a fixed portion arranged on an upstream side;

a movable flap arranged on a downstream side; and a transfer slot defined between a trailing surface of the fixed portion and a leading surface of the movable flap, the movable flap having opposite pressure and suction sides extending along a chord line between leading and trailing edges, the movable flap being rotatable about an axis extending along a span of the movable flap over a range of angular positions between open and closed, the trailing surface having a substantially U-shaped profile with a first branch extending partially around the pressure side of the movable flap, and an opposite second branch extending partially around the suction side of the movable flap, the transfer slot having an inlet port arranged on the pressure side of the movable flap and an exhaust port arranged on the suction side of the movable flap, wherein in use, in the open position the suction side abuts the second branch to close the exhaust port, and in the closed position the second branch directs a first air flow passing through the transfer slot tangentially over the suction surface of the movable flap.

2. The variable guide vane as claimed in claim 1, wherein the fixed portion comprises an internal cavity, the internal cavity being in fluid communication with the transfer slot, the internal cavity being supplied with air at a pressure higher than the airflow passing through the transfer slot, and, in use, directing a second air flow into the transfer slot, directed towards the exhaust port, to thereby supplement the first air flow.

3. The variable guide vane as claimed in claim 2, wherein the internal cavity is fluidly connected to the transfer slot by a plurality of feed slots, the feed slots being arranged along the span of the movable flap.

4. The variable guide vane as claimed in claim 1, wherein the transfer slot has a convergent flow path in a direction extending from the pressure side of the movable flap to the suction side of the movable flap.

5. The variable guide vane as claimed in claim 1, wherein a camber line of the movable flap is coincident with the chord line.

6. The variable guide vane as claimed in claim 1, wherein the axis of the movable flap is offset from the chord line.

7. The variable guide vane as claimed in claim 6, wherein the offset of the axis is in a direction extending towards the pressure side of the movable flap.

8. The variable guide vane as claimed in claim 1, wherein the second branch has an elliptical sectional profile.

9. The variable guide vane as claimed in claim 2, further comprising a heater adapted to impart heat energy to the second air flow.

10. A gas turbine engine comprising a variable guide vane as claimed in claim 1.

* * * * *